United States Patent [19]

Ritchie et al.

[11] 4,212,510

[45] Jul. 15, 1980

[54] FILTERED HEADER

[75] Inventors: Leon T. Ritchie, Mechanicsburg; Michael S. Peppler, Lancaster, both of Pa.

[73] Assignee: AMP Incorporated, Harrisburg, Pa.

[21] Appl. No.: 960,532

[22] Filed: Nov. 14, 1978

[51] Int. Cl.[2] ..... H01R 3/06

[52] U.S. Cl. ..... 339/147 R; 333/183

[58] Field of Search ..... 339/147 R, 147 P, 136 M, 339/DIG. 3; 333/18 R, 183, 174, 35 R, 35 C

[56] References Cited

U.S. PATENT DOCUMENTS

| | | | |
|---|---|---|---|
| Re. 29,258 | 6/1977 | Fritz | 333/70 S |
| 3,002,162 | 9/1961 | Garstang | 339/147 R X |
| 3,435,387 | 3/1969 | Reinke et al. | 333/79 |
| 3,535,676 | 10/1970 | Schultz | 339/147 R X |
| 3,573,677 | 4/1971 | Detar | 333/183 |
| 3,703,701 | 11/1972 | Zimmerman | 339/147 R X |
| 3,710,285 | 1/1973 | Schor et al. | 339/147 R X |
| 3,721,869 | 3/1973 | Paoli | 339/147 R X |
| 3,743,978 | 7/1973 | Fritz | 333/79 |
| 3,897,131 | 7/1975 | Stauffer | 339/220 R |
| 3,961,294 | 1/1976 | Hollyday | 339/147 R X |
| 4,020,430 | 4/1977 | Vander Heyden | 339/147 R X |
| 4,144,509 | 3/1979 | Boutros | 339/147 R X |

*Primary Examiner*—Roy Lake
*Assistant Examiner*—Eugene F. Desmond
*Attorney, Agent, or Firm*—Russell J. Egan

[57] ABSTRACT

An improved filtered header or feedthrough connector is disclosed for retrofitting filtered terminals into an existing electronic circuit. Each of a plurality of terminals is provided with filter sleeves which are soldered thereto. The filtered terminal assemblies are inserted into a header housing in a fixed array. At least one conductive rubber gasket on the housing interconnects the filters to a ground plane. A metal bushing can be mounted on the conductive rubber gasket to make an interconnection with mounting means, such as a bulkhead. The elastomeric ground plane engages the filters in such a manner as to apply a biasing force to the filters without creating such a high force that there would be a possibility of destroying the filters. The header housing also allows for accommodating filters of various sizes as well as for having terminal pins pass straight through without any filtering.

17 Claims, 4 Drawing Figures

FIG. 1
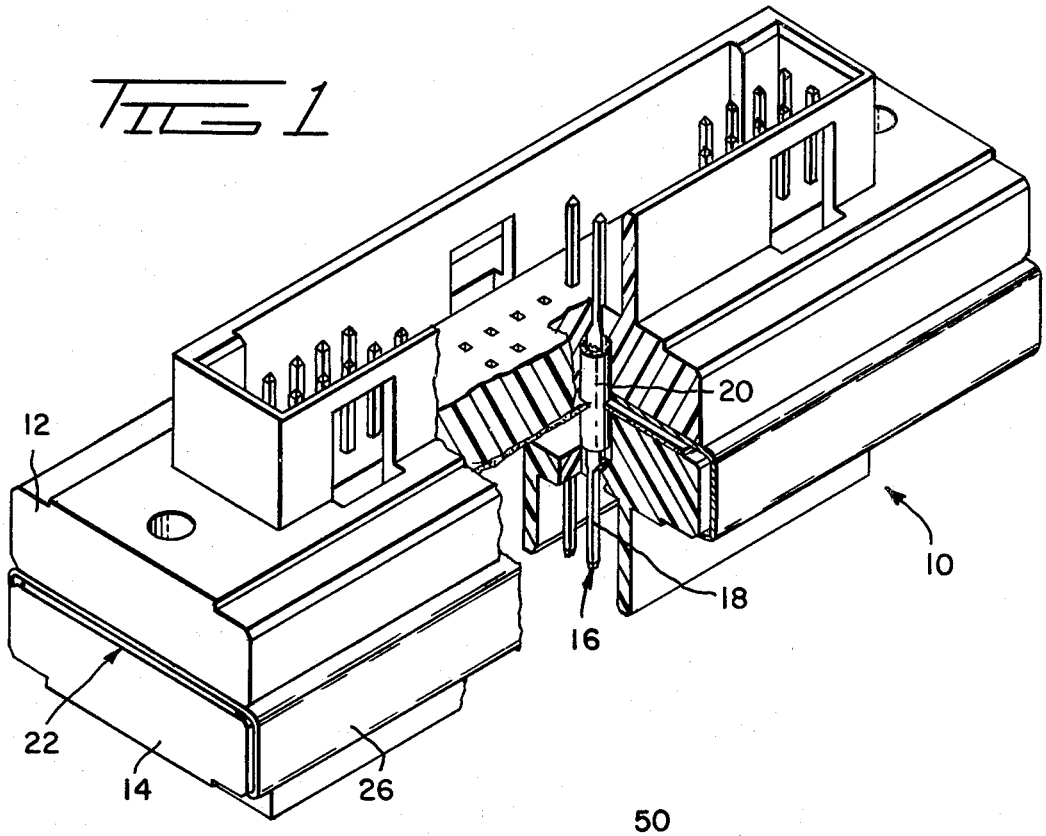
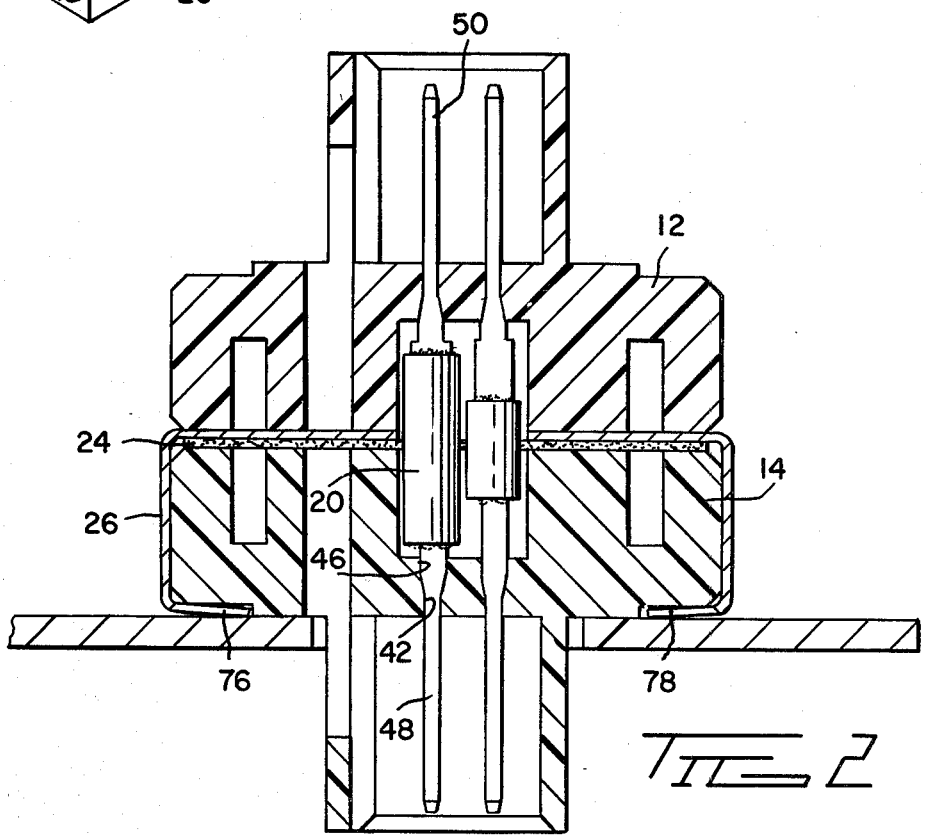
FIG. 2

20
58
52
54
56
52
48
54
56
48
40
34
38
36
46
42
44
80
12
18
50
16
20
48
62
24
60
62
84
30
34
28
32
38
36
82
14
72
64
70
66
74
26
76
86
68
78

FILTERED HEADER

BACKGROUND OF THE INVENTION

1. The Field of the Invention

The present invention relates to filtered header assemblies and in particular to a filtered header assembly or feedthrough connector which can be provided with a variety of filter configurations.

2. The Prior Art

It has been well known in the electronic industry that there are often times when it is essential to provide EMI filtering in electronic circuitry. A line of ferrite-ceramic filters have been developed which accomplish the necessary filtering. An example of such known filters is disclosed in U.S. Pat. Nos. 3,743,978 and Re 29,258. These filters are manufactured in the form of a cylindrical sleeve and are secured to a pin type terminal by soldering. It is then necessary to mount the filter-pin assembly in some sort of housing device without applying excessive forces to the filter which could easily cause the destruction thereof. An example of known techniques for mounting filters can be found in U.S. Pat. Nos. 3,703,701 and 3,710,285. Basically all the prior attempts for mounting filter sleeves have evolved around forming a stamped metal ground plate and inserting the filters into apertures formed in the plate. However, this has not always proved to provide satisfactory mounting since forces of sufficient magnitude to break and destroy the filter sleeve are often developed.

SUMMARY OF THE INVENTION

The present filtered header or feedthrough connector is an assembly of a pair of mating housing members, a ground system, and a plurality of filtered terminals. Each terminal is preferably stamped and formed to a known configuration and has a cylindrical filter sleeve secured thereto by conventional soldering. The mating housing members define therebetween at least one chamber which will receive the filter portion of each filtered terminal assembly with the ends of the terminal projecting through the housing members at suitable mating positions. The ground system lies intermediate the housing members and consists of at least a conductive rubber portion which can be formed by molding or stamping. The conductive rubber provides mechanical forgiveness needed to accommodate tolerances in the filter sleeve while making intimate contact with all sides of the exterior of the filter sleeve. A stamped and formed metal shroud can be provided to both hold the rubber portion in place and form a low impedance path between the filter and the mounting location. The header can be forward or back panel mounted with positive grounding to the panel without utilizing separate EMI gasketing.

It is therefore an object of the subject filtered header to provide means for retrofitting filtered terminals into existing electronic circuitry.

It is another object of the present invention to produce a filtered header which will overcome the previous mechanical difficulties experienced when filtered terminals were mounted in metal ground planes exerting sufficient force on the filters to cause the destruction thereof by providing a substantially stress free mounting of the filters.

It is still another object of the present invention to produce a filtered header which is fully serviceable for replacement and/or interchange of filtered terminals of various capacities and configurations.

It is a further object of the present invention to produce a filtered header which provides the option of levels of filtering, selective grounding, and unfiltered terminals in the same connector and in any configuration.

It is a further object of the present invention to produce a filtered header which obviates the need for separate EMI gasketing.

It is a still further object of the present invention to produce a filtered header which can be either forward or back panel mounted.

It is a still further object of the present invention to produce a filtered header suitable for mating with discrete wire, ribbon cable or flat conductor connectors.

It is a still further object of the present invention to produce a filtered header which can be readily and economically manufactured.

The means for accomplishing the foregoing objects and other advantages of the present invention will become apparent to those skilled in the art from the following detailed description taken with reference to the accompanying drawings.

BRIEF DESCRIPTION OF THE DRAWINGS

FIG. 1 is a perspective view, partially in section, of a preferred embodiment of the subject filtered header assembly;

FIG. 2 is a vertical transverse section through the filtered header assembly of FIG. 1;

DETAILED DESCRIPTION OF THE PREFERRED EMBODIMENT

Figures 3, 4:
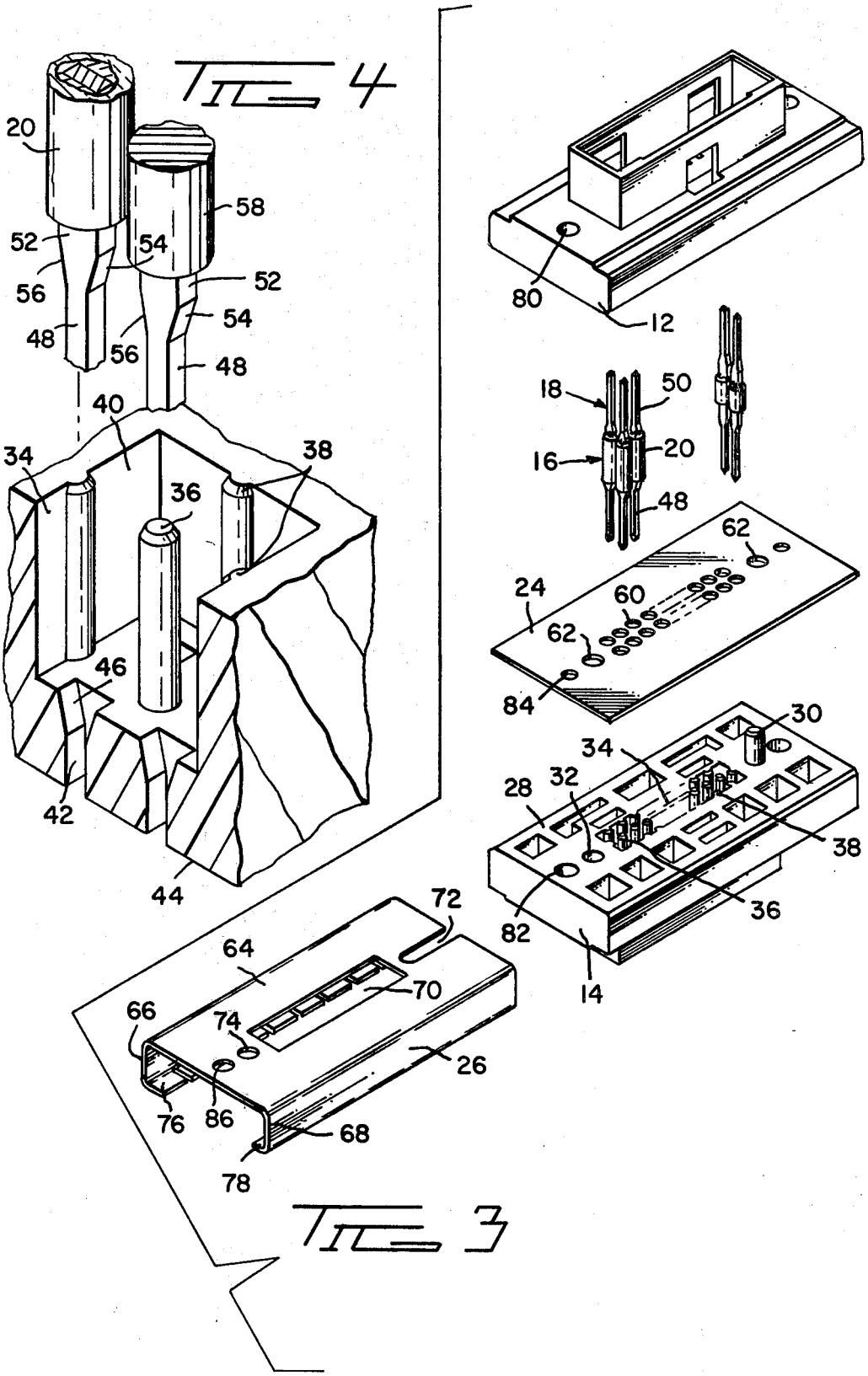
FIG. 3 is an exploded perspective view of the subject filtered header.
FIG. 4 is a detailed view of a fragment of one of the mating housing members.

The subject filtered header assembly or feed-through connector 10 includes mating housing members 12, 14, a plurality of filter-terminal assemblies 16 each including a terminal 18 and a cylindrical filter sleeve 20, and a ground system 22 including a conductive elastomer sheet 24 and a stamped and formed metal shroud 26.

The mating housing members 12, 14 are preferably hermaphroditic each having a first planar mating face 28 with a keying pin 30, and keying recess 32 at opposite ends thereof. The housing also defines a centrally located, elongated profiled recess 34. The recess is profiled by free standing posts 36 and arcuate projections 38 on the peripheral walls of the cavity to define a plurality of filter sleeve receptacles 40. It will also be noted from FIG. 4 that a terminal bore 42 extends from the second mating face 44 to each receptacle 40 and has a tapered entry 46 directed towards the receptacle. The second mating face 44 of each housing member is profiled for mating with a conventional electrical connector (not shown).

The filter-pin assemblies 16 each comprise a preferably stamped and formed terminal pin 18 of known configuration. The pins shown have mating opposite end portions 48, 50 of generally square section joined to an enlarged central portion 52 by sloping shoulders 54, 56. Each of these terminal pins is inserted through the central bore of a cylindrical filter sleeve 20 and secured thereto by means of soldering. The filter sleeve 20 is preferably of the type disclosed in U.S. Pat. No. Re 29,258, the disclosure of which is incorporated herein by reference. It should be noted that the filters can be of different lengths, as shown in FIGS. 2 and 3, or that the terminal can be formed with a cylindrical enlarged central portion 58 and not filtered, as shown in FIG. 4.

The ground system 22 includes at least a sheet of conductive rubber 24 which has a plurality of apertures 60 corresponding to the receptacles 40 in the recess 34 of the housing members. The rubber can be formed as a sheet and have the apertures stamped therein or molded with the apertures. It is also provided with apertures 62 for the passage of the centering and keying pins 30. The metal shroud 26 has a generally channel shape configuration with a base portion 64 and sidewalls 66, 68. There is an elongated central aperture 70 formed in the base portion together with a slot 72 at one end for the passage of a keying pin 30 and an aperture 74 for the passage of the other keying pin. The upper free edges of the sidewalls 66, 68 are inwardly turned at 76, 78 and formed into a plurality of resilient fingers. The housing members 12, 14, conductive rubber 24 and metal shroud 26 all are provided with aligned apertures 80, 82, 84, 86, respectively at the opposite ends thereof for the passage therethrough of means (not shown) to secure the assembly together.

The filtered header 10 is assembled in the following fashion. A plurality of terminal pins 18 are provided with filter sleeves 20 which are soldered thereto. The grounding system 22 is applied to one mating housing member 14 with the conductive rubber being applied immediately against the mating face 28. The metal shroud 26 is slid longitudinally across the housing member 14 to secure the conductive rubber 24 in place. The individual filtered terminals are then placed in the appropriate receptacles 40 in gang or individual fashion and in accordance with the desired configuration. It will be noted that the tapered shoulders 54, 56 of the pins will fit into the tapered entry portion 46 of the bores 42 (see FIG. 2) thereby assuring that the filter sleeves 20 will not engage the housing members 12, 14 and thereby be subjected to a compressive force. The conductive rubber 24 will also assure that the filters are not subject to excessive radial forces and yet will be adequately contacted for electrical purposes. The mating housing member 12 is then applied with the other ends of the terminals passing through the like bores 42 and abutting against inclines 46 to hold the filtered terminals firmly in place. The keying pins 30 will engage in the corresponding keying recesses 32.

It should be clear from the foregoing description that the subject header totally captivates the filtered terminal in the cavity formed by the recesses of the mating housing members 12, 14. The filter sleeve 20 is grounded by the conductive rubber 24 and the large metal ground impedance reducing system of the shroud carries the ground to a mounting location external of the housing members. Since the housing members are hermaphroditic, the assembly can be either forward or back panel mounted with the shroud engaging the panel. Stress free assembly is provided by the tapered shoulders of the terminal on either end of the filter sleeve mating with like tapers in the mating housing members. The housing members also have the tapers formed as an integral portion of the terminal bores. If during mating of the subject header with a receptacle connector stubbing of one or more terminals should occur, there will be no axial movement of the terminal which could damage the filter since the tapered shoulders engage the taper molded into the housing thereby causing the pin to bottom in the cavity rather than for the filter to bottom. As a result the filter cannot be exposed to mechanical stresses in the present housing. The subject filtered header is fully serviceable in that it can be readily disassembled and bent pins removed or filtered terminals replaced as desired.

It should also be noted that the aperture 70 in shroud 26 could be formed as a grid (not shown) if space permitted and the extra impedance desired. Further, the terminals could have a male pin configuration on one end and a female receptacle configuration on the opposite end.

The second mating faces of the housing members can have any profile, for example, the profiles shown in U.S. Pat. Nos. 3,065,447; 3,101,229 and 3,758,935.

The ground system can use any of the well known materials to form the conductive rubber sheet. For example, suitable materials are either Consil E or SC-Consil, both of which are products of Tecknit Co. of Cranford, N.J.

The present invention may be subject to many modifications and changes without departing from the spirit or essential characteristics thereof. The present embodiment is therefore to be considered in all respects as illustrative and not restrictive of the scope of the invention.

What is claimed is:

1. A filtered header or feedthrough connector comprising:

a pair of hermaphroditic housing members of insulative material each having a planar first mating face and a profiled second mating face, a recess in each said planar face, said recesses together defining a cavity, each said recess having a profiled periphery and a plurality of free standing posts, said posts and profiled periphery defining a plurality of filter receiving receptacles, and a like plurality of terminal bores each extending from said second faces to a respective receptacle;

a ground system having a conductive rubber sheet with a plurality of apertures therein, each said aperture being aligned with a respective filter receiving receptacle in said housing members, said conductive rubber being held between said first mating faces; and a plurality of filtered terminal assemblies each including an elongated terminal with a filter sleeve secured intermediate the ends thereof and received in said cavity with the filter sleeve engaging said conductive sheet and the ends of the terminal projecting from said second mating faces to engage associated terminals.

2. A connector according to claim 1 wherein each said housing member further comprises:

keying means in said planar first mating faces.

3. A connector according to claim 1 wherein said second mating face of each said housing member is profiled for mating with a conventional electrical connector.

4. A connector according to claim 1 further comprising means to couple said housing members together with said ground system therebetween.

5. A connector according to claim 1 further comprising means to mount said connector to a panel in either a forward or back panel condition.

6. A connector according to claim 1 wherein each said terminal bore has a tapered entry from said recess whereby a terminal in said passage is restrained from axial movement.

7. A connector according to claim 1 further comprising:

a metal shroud adapted to secure said conductive rubber sheet to one of said housing members, said shroud being apertured so as to allow through passage of said filtered terminal assemblies.

8. A connector according to claim 7 wherein said metal shroud has a single aperture of sufficient size to encompass all of said filtered terminal assemblies.

9. A connector according to claim 7 wherein said metal shroud has a plurality of apertures each aligned with a respective aperture in said conductive rubber sheet.

10. A connector according to claim 7 wherein said metal shroud has a channel shape adapted to grip one of said housing members to hold said conductive rubber sheet against said planar first mating face.

11. A connector according to claim 10 wherein said metal shroud includes resilient tines adapted to engage a ground panel.

12. A connector according to claim 1 wherein each said filter-terminal assembly comprises:

an elongated terminal; and a cylindrical RFI/EMI filter secured intermediate the ends of said terminal.

13. A connector according to claim 12 wherein said elongated terminal includes at least one shoulder means adapted to engage in a respective terminal bore of said housing so as to prevent axial movement of said assemblies within said housings.

14. A connector according to claim 12 wherein said filter is a ferrite-ceramic filter.

15. A connector according to claim 12 wherein each said terminal has at least one end formed as a pin and an enlarged central portion.

16. A filtered header or feedthrough connector for retrofitting existing electronic circuitry to provide RFI/EMI filtering, comprising:

a pair of mating housing members together defining a cavity therebetween, a plurality of terminal bores extending through said members and entering said cavity in a spaced array;

a ground system including a conductive rubber sheet interposed between said housing members, a plurality of apertures in said sheet each aligned with a respective terminal bore in said array, a metal shroud adapted to secure said conductive rubber sheet to one of said housing members, said shroud having a single aperture of sufficient size to encompass and to allow through passage to all of said apertures in said sheet;

a plurality of filter-terminal assemblies each including a filter sleeve secured intermediate the ends of an elongated terminal, each assembly being received with the filter sleeve portion thereof lying within said cavity and engaging in an aperture in said conductive sheet with at least wiping contact and the ends of the terminal projecting from said terminal bores in said housing members to engage associated terminals.

17. A filtered header or feedthrough connector for retrofitting existing electrical connectors of known configurations to provide RFI/EMI filtering, comprising:

a pair of hermaphroditic housing members each having oppositely directed mating sides, the first of which has an overall profile matable with a known electrical connector and the second of which is substantially planar;

a ground plane secured to and extending across the second mating side of one of said members by a channel-shaped metal shroud, said ground plane having a plurality of apertures therein each aligned with a respective terminal of said known electrical connector, said metal shroud having a single aperture of sufficient size to encompass all of said apertures and a channel shape adapted to grip said one housing member and resilient tines adapted to engage a ground panel;

a like plurality of filter sleeves each engaged in a respective one of said apertures of said ground plane;

a like plurality of terminals each mounted in a respective one of said filter sleeves, each said terminal having opposite ends projecting from said housing members; and means to mount said connector with said ground plane engaging a ground source.

* * * * *